US008186269B2

(12) United States Patent
Deguchi

(10) Patent No.: US 8,186,269 B2
(45) Date of Patent: May 29, 2012

(54) STAMP-TYPE PRINTER

(75) Inventor: Masanobu Deguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 492 days.

(21) Appl. No.: 12/491,620

(22) Filed: Jun. 25, 2009

(65) Prior Publication Data

US 2009/0320701 A1 Dec. 31, 2009

(30) Foreign Application Priority Data

Jun. 30, 2008 (JP) ..... 2008-170704
Feb. 3, 2009 (JP) ..... 2009-022657

(51) Int. Cl.
*B41K 1/26* (2006.01)
*B41K 1/30* (2006.01)

(52) U.S. Cl. ..... 101/41; 101/327; 101/492; 400/88; 347/109

(58) Field of Classification Search ..... 101/327, 101/333, 405, 406, 41, 492, 493; 400/88; 347/109; *B41K 1/26, 1/30*
See application file for complete search history.

(56) References Cited

U.S. PATENT DOCUMENTS

| | | | | |
|---|---|---|---|---|
| 2007/0182805 | A1* | 8/2007 | Silverbrook | 347/109 |
| 2008/0041250 | A1* | 2/2008 | Clark et al. | 101/217 |
| 2008/0267673 | A1* | 10/2008 | Tao et al. | 399/302 |

FOREIGN PATENT DOCUMENTS

| | | | |
|---|---|---|---|
| JP | 62-193900 | A | 8/1987 |
| JP | 3-169634 | A | 7/1991 |
| JP | 5-49346 | U | 6/1993 |
| JP | 7-171990 | A | 7/1995 |
| JP | 8-298568 | A | 11/1996 |
| JP | 10-119360 | A | 5/1998 |
| JP | 10-269318 | A | 10/1998 |
| JP | 2001-47731 | A | 2/2001 |
| JP | 2002-264399 | A | 9/2002 |
| JP | 2004-106329 | A | 4/2004 |
| JP | 2006-53875 | A | 2/2006 |
| JP | 2006-69117 | A | 3/2006 |
| JP | 2006-289991 | A | 10/2006 |
| JP | 2006-301041 | A | 11/2006 |
| JP | 2007-62207 | A | 3/2007 |
| JP | 2007-272112 | A | 10/2007 |

* cited by examiner

*Primary Examiner* — Leslie J Evanisko
(74) *Attorney, Agent, or Firm* — Birch, Stewart, Kolasch & Birch, LLP

(57) ABSTRACT

The stamp-type printer includes: a stamp-type printer comprising: a receiving section for receiving image data including character information; a transfer member; a print head for printing an image on a portion of the transfer member with ink based on the received image data; and a transport member for transporting the printed portion of the transfer member to a contact transfer position, wherein a stamping operation is performed by causing the printed portion to come in contact with a desired recording medium at the contact transfer position.

21 Claims, 16 Drawing Sheets

STAMP-TYPE PRINTER

CROSS-REFERENCE TO RELATED APPLICATIONS

This application is related to Japanese applications No. 2008-170704 filed on Jun. 30, 2008 and No. 2009-22657 filed on Feb. 3, 2009, whose priorities are claimed under 35 USC §119, the disclosures of which are incorporated by reference in their entireties.

BACKGROUND OF THE INVENTION

1. Field of the Invention

The present invention relates to a stamp-type printer, and more particularly to a compact sized printer for forming an image on a recording sheet.

2. Description of the Related Art

A printer, a multi-function device, and a printing device that prints an image stored in a digital camera on a photograph-sized sheet or a special sheet, each have a large size so as to print the image on a whole sheet. A simple stamp typified by a rubber stamp, which has a small size, is able to print letters or figures on any types of paper sheets, but the letters or figures are unchangeable.

On the other hand, a compact device has been developed which is capable of directly stamping the data received from a personal computer, a mobile phone, a digital camera or the like on a paper sheet in the same manner as a conventional printer. For example, known is a stamp-type printer having a thermal transfer system, in which a thermal head is moved over the ink ribbon placed on a desired object to be printed (see, for example, Japanese Unexamined Patent Application No. 2002-264399).

However, such a conventional stamp-type printer needs to be kept immobile with respect to a printing object while the thermal head is activated. Accordingly, the conventional stamp-type printer takes a much longer operation time compared to the rubber stamp, that is, it cannot achieve a satisfactory printing operation unless the printer is kept immobile for such a long time.

SUMMARY OF THE INVENTION

The present invention has been invented in view of the above described situation, and provides a stamp-type printer which is capable of easily performing a stamping operation of a desired image as if the operation is performed with a rubber stamp.

The present invention provides a stamp-type printer including: a receiving section for receiving image data including character information; a transfer member; a print head for printing an image on a portion of the transfer member with ink based on the received image data; and a transport member for transporting the printed portion of the transfer member to a contact transfer position; wherein a stamping operation is performed by causing the printed portion to come in contact with a desired recording medium at the contact transfer position.

According to the present invention, an image based on the received image data is printed on a portion of the transfer member with ink discharged from the print head, and the printed portion of the transfer member is transported to the contact transfer position by the transport member. Therefore, when the printed portion comes in contact with a desired recording medium, a stamping operation, i.e., contact transfer of the image is performed promptly.

DETAILED DESCRIPTION OF THE INVENTION

Figure 1A:
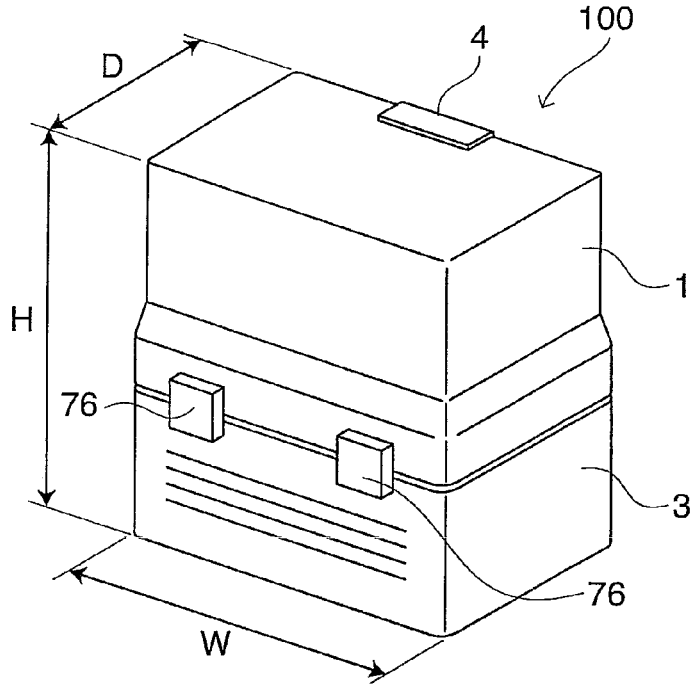
FIGS. 1A and 1B are perspective views showing outer appearances of a stamp-type printer of the present invention.

A stamp-type printer according to the present invention includes: a receiving section for receiving image data including character information; a transfer member; a print head for printing an image on a portion of the transfer member with ink based on the received image data; and a transport member for transporting the printed portion of the transfer member to a contact transfer position; wherein a stamping operation is performed by causing the printed portion to come in contact with a desired recording medium at the contact transfer position.

Here, the receiving section for receiving the image data may be typified by a photoreceptor receiving an infrared signal, a receiver for receiving a radio signal, and the like.

Preferably, the stamp-type printer further includes an infrared ray receiving element, and a control section for causing the receiving section to receive the image data through the infrared ray receiving element and for causing the print head to execute a printing operation.

The print head may include an inkjet head with an ink discharge nozzle array, and the transfer member may include an endless belt, the print head printing the image onto the transfer member when the ink discharge nozzle array discharges ink in a main scanning direction of the endless belt and the transport member may cause the endless belt to move in a subscanning direction.

Still further, examples of the desired recording medium are a note book, a date book, a name card, a receipt, a rear surface of an advertising leaflet, a calendar, a shirt, a handkerchief, and a sheet of tissue paper, in addition to a common printing sheet.

The stamp-type printer may further include a frame body for supporting the print head, the transfer member, and the transport member, and a housing for accommodating the frame body, wherein the housing has an opening for causing the printed portion located in the contact transfer position to be exposed therethrough.

The housing may include an upper casing removably supported by the frame body, and a lower casing having the opening.

The lower casing may support the frame body through a resilient member, and the printed portion may be exposed through the opening to come in contact with the recording medium, when the frame body is moved with respect to the lower casing in a manner to resist the resilient member.

The stamp-type printer may further include a cover detachably attached to the housing to cover the opening.

The stamp-type printer may further include a cover detachably attached to the housing to cover the opening, wherein the cover is adapted to prevent the frame body from moving with respect to the lower casing when the cover is attached to the housing.

The stamp-type printer may further include: a control section for driving the print head and the transport member; and a power source for supplying power to the control section through a switch, wherein the switch is opened when the cover is detached from the housing and closed when attached to the housing.

The stamp-type printer may further include a cleaning member for cleaning the transfer member.

The stamp-type printer may further include: a cleaning member for cleaning the transfer member; and a battery for driving the print head, wherein the cleaning member and the battery are supported by the frame body and are replaceable when the upper casing is removed.

The stamp-type printer may further include a display section for indicating a timing at which reception of the image data is ready.

The stamp-type printer may further include a display section for indicating that the printed portion of the transfer member has been transported to the contact transfer position.

The stamp-type printer may further include: a storage section for temporarily storing the received image data; and a manual instruction member for providing an instruction to the control section to cause the print head to print the stored data on the transfer member.

The control section may include a time measuring section for measuring time, and the control section may delete the image data stored in the storage section when the manual instruction member provides no instruction over a predetermined period of time.

The stamp-type printer may further include: a detector for detecting a position of the transfer member; and a control section for driving the transport member in accordance with an output from the detector.

The cover and the frame body may include a mechanism for causing the transfer member to come in contact with the print head when the cover is attached to the housing.

Accordingly, the transfer member is in close contact with the print head when the stamp-type printer is not used, whereby it is possible to prevent the ink from being dried, and also to prevent clogging of the nozzle.

The frame body may include a holding member for holding the transfer member distant from the print head when the print head prints the image on the transfer member, and the cover may include ribs for causing the transfer member to come in contact with the print head when the cover is attached to the housing.

The transfer member may include an endless transfer belt, and the transport member may include a drive roller and a tension roller which drive the transfer belt.

The stamp-type printer may further include a supporting member for supporting the transfer belt at a rear surface of the transfer belt.

The stamp-type printer may further include an urging member for urging the tension roller to apply tension to the transfer belt.

The transfer belt may have a front surface coated with a PFA or a PTFE.

Hereinafter, the present invention will be described based on embodiments shown in the drawings.

Figure 1B:
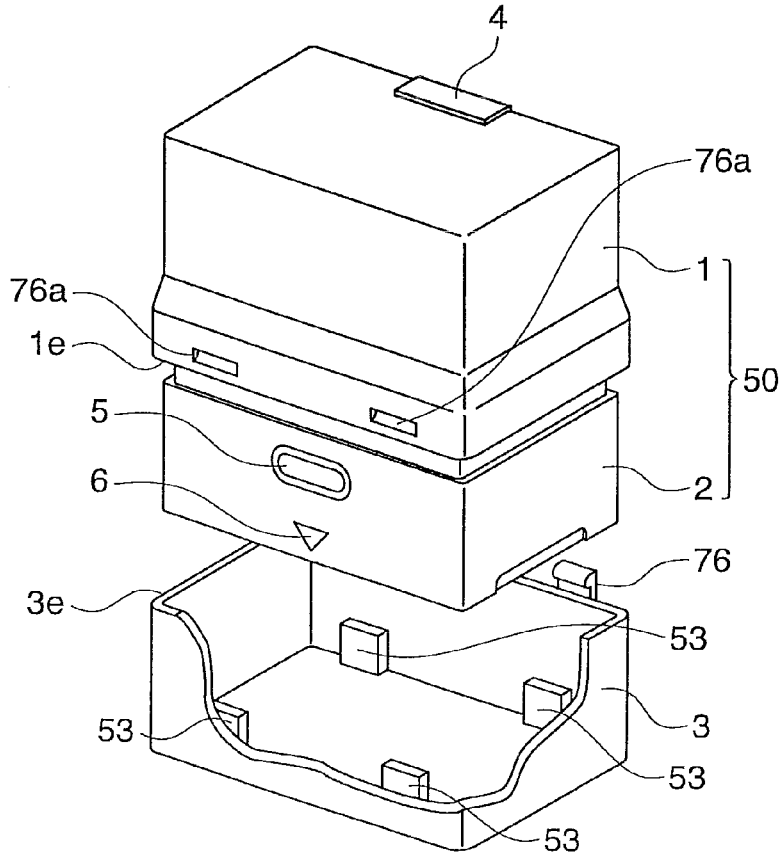

FIGS. 1A and 1B are perspective views showing a stamp-type printer of the present invention. As shown in FIG. 1A, a stamp-type printer 100 is 60 mm in width (W), 40 mm in depth (D), and 72 mm in height (H). When performing a stamping operation, a cover 3 is pulled downward to be removed as shown in FIG. 1B. A housing 50 is composed of an upper casing 1 and a lower casing 2.

When attaching the cover 3 to the housing 50, the cover 3 is fitted to the lower casing 2 from its lower side such that the lower casing 2 is inserted thereto, and the upper casing 1 is pressed down onto the cover 3. Accordingly, a locking claw 76 disposed at an upper peripheral surface of the cover 3 is locked into a recessed portion 76*a* on a lower peripheral surface of the upper casing 1 with a snap action. Then, the cover 3 is fixed to the upper casing 1 while an edge 1*e* of the upper casing 1 and an edge 3*e* of the cover 3 abut each other. The upper casing 1 includes an infrared ray receiving section 4 made of transparent resin, and the lower casing 2 includes an LED section 5.

When the cover 3 is removed, an internal power supply is turned on, and the LED section 5 is lit in red for 1 to 2 seconds, and then continuously lit in green. After the LED section 5 is lit in green, when image data is outputted from a portable terminal or the like, which is not shown, in a form of an infrared ray, the data is received by the infrared ray receiving section 4, and the LED section 5 blinks in green upon the completion of the reception of the data. A time period taken during the above operation, i.e., a time period required for data transfer is about 2 seconds. Blinking in green indicates that the stamping operation is ready.

Figure 2B:
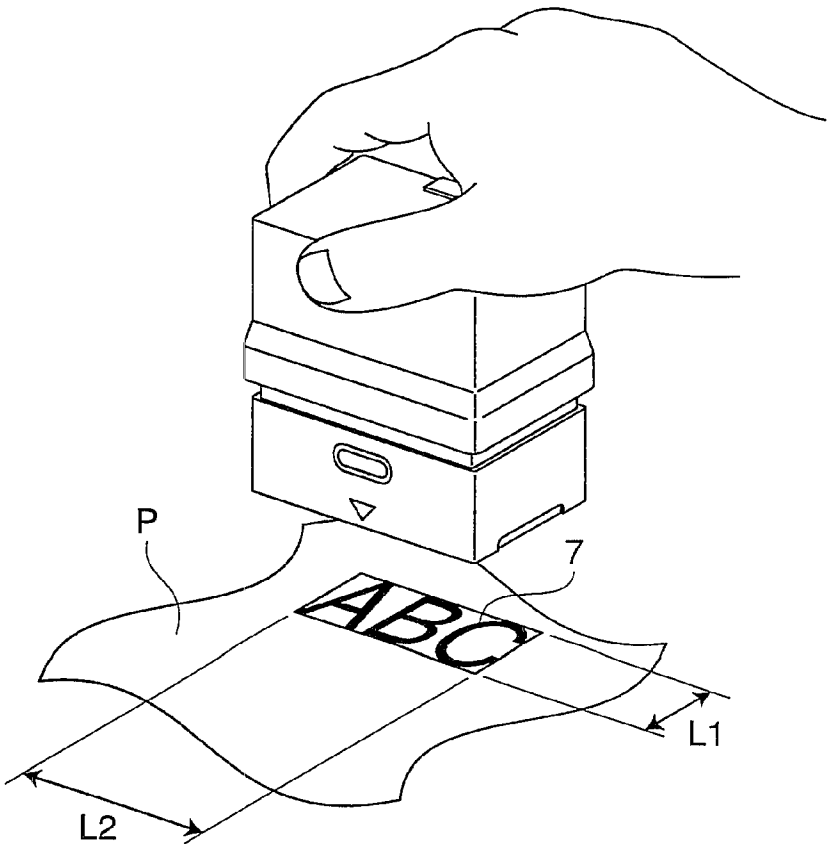
FIGS. 2A and 2B are a schematic diagrams showing states where the stamp-type printer of the present invention is used.
Figure 2A:
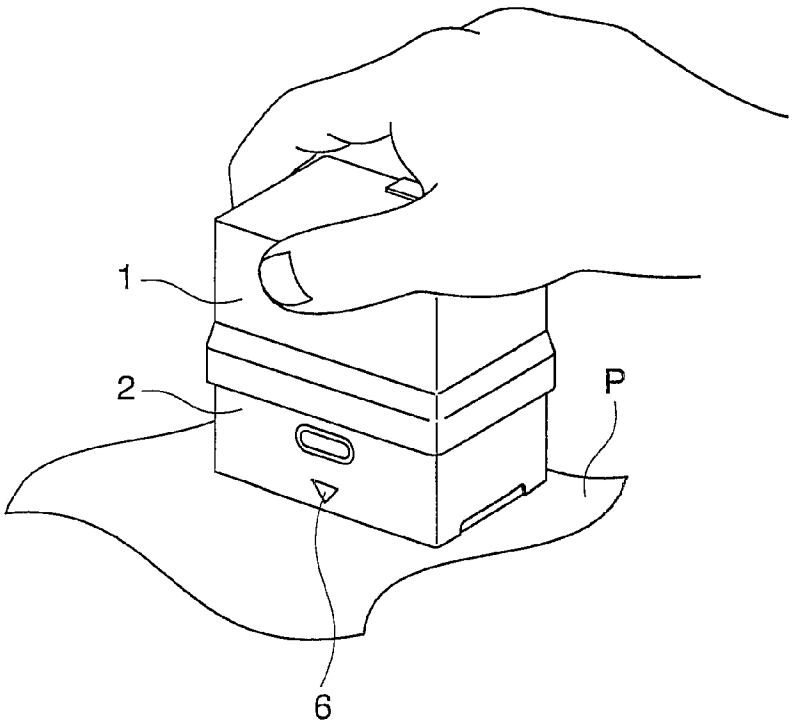

Accordingly, as shown in FIG. 2A, with the upper casing 1 in his/her hand, a user locates the printer 100 in a desired stamp position on a printing sheet P referring to a mark 6 provided on the lower casing 2 and presses the upper casing 1 down to perform a stamping operation.

This pressing stroke is 4 mm in the case of the present embodiment. As shown in FIG. 2B, when the upper casing 1 is raised, the printing operation onto the printing sheet P is completed, and then the LED section 5 is again lit in green continuously.

The upper casing 1 and the lower casing 2 of the stamp-type printer 100 are connected through springs as described later, and thus the printer 100 does not perform a stamping operation unless the upper casing 1 is pressed by at least 4 mm even if the stamp-type printer 100 is placed on a desk so as to face downward.

When the cover 3 (FIG. 1) is fitted to the lower casing 2, the internal power supply is disconnected, and the LED section 5 is turned off.

In addition, as above described, when the cover 3 is fitted, the edge 3*e* of the cover 3 and the edge 1*e* of the upper casing 1 abuts each other, and thus the upper casing 1 is not able to come close to the lower casing 2.

FIG. 2B shows a stamped image 7, i.e., characters ABC. The image may be other characters representing a name, an address, or the like, and an image such as a photograph and a map, alternatively. A maximum printable size in the present embodiment is 11 mm in length (L1) and 35 mm in width (L2). When the stamp-type printer 100 is enlarged in size, a printable range may be also increased.

According to the printer of the present invention, the printing sheet P to be stamped may be a personal date book, a name card, a receipt, or a rear surface of an advertising leaflet. Further, it is possible to directly stamp a schedule on a calendar hung on the wall. It is also possible to stamp an image on a shirt, a handkerchief, or a sheet of tissue paper.

When a continue button (which is also used as the LED section 5), which is a manual instruction member provided to the lower casing 2, is pressed after the stamping operation, the LED section 5 is switched from a state of continuous lighting in green to a state of blinking in green, and consequently, it is possible to again stamp the data that has been stamped.

When the operation is repeated, it is possible to stamp the same image many times, and thus it is possible to use the stamp-type printer 100 in the same manner as a rubber stamp. Accordingly, the stamp-type printer 100 can be also conveniently used as a stamp for stamping a confidential marking or a date.

Further, when address data stored in a personal computer or a personal terminal is sent to the stamp-type printer 100, it is possible to print the address on an envelope or a postcard. With the use of the stamp-type printer 100, it is possible to omit a series of operations, that is, printing of an address on address labels of an A4 size label sheet, removing the address label from the label sheet, and attaching the address label to an envelope or a postcard, which are usually performed. Instead, the stamp-type printer 100 enables a direct printing operation and does not need the label sheet.

Further, it is possible to print information such as a photograph and a map, which is called up on the liquid crystal display of a portable phone, on a date book or on a name card through infrared communication. Still further, it is possible to print an image displayed on a personal computer on a gift wrapping paper sheet.

Figure 3:
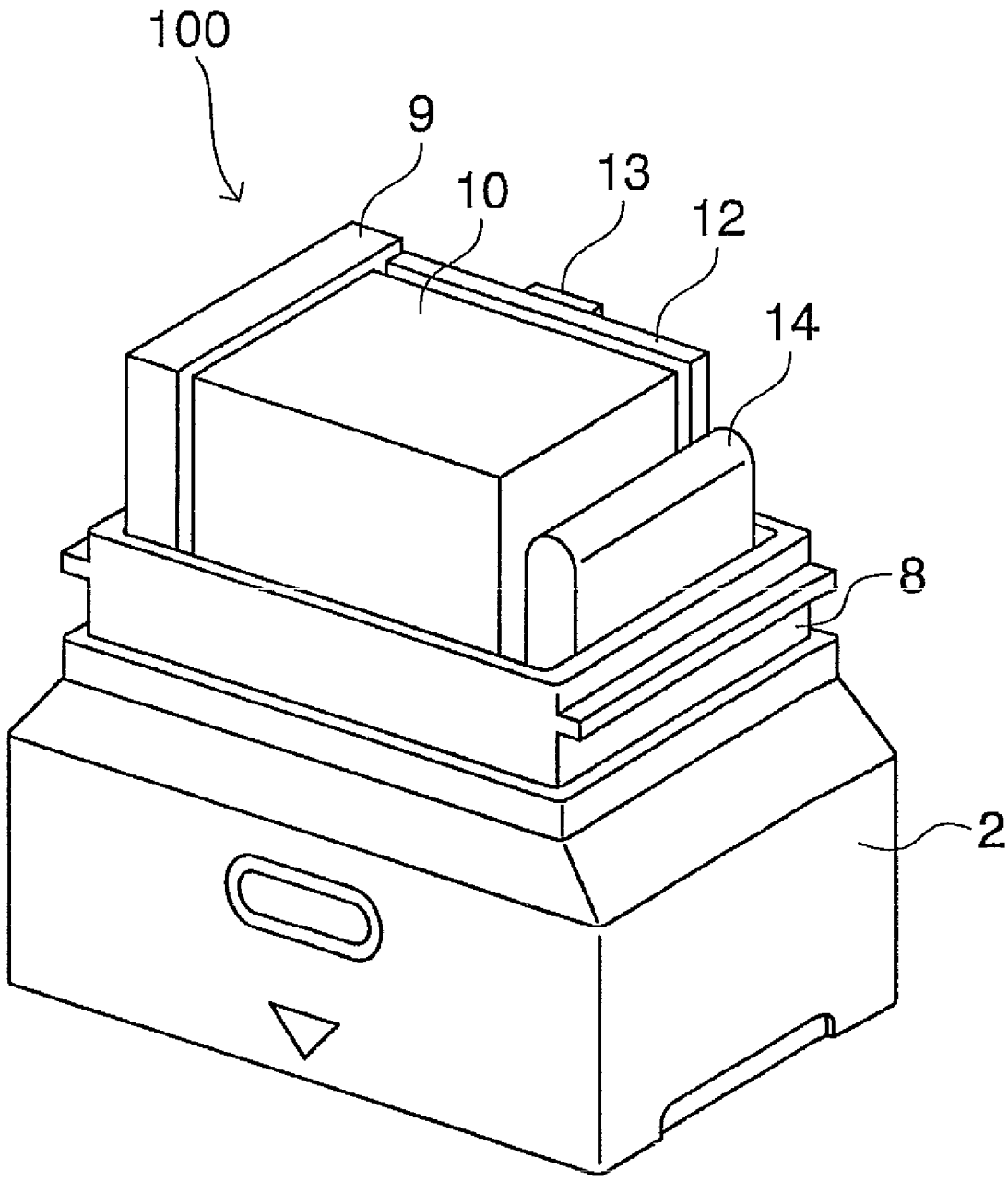
FIG. 3 is a perspective view of the stamp-type printer shown in FIG. 1 in a state where an upper casing is removed.

FIG. 3 is a perspective view showing the stamp-type printer 100 in a state where the upper casing 1 is removed. The upper casing 1 is removably supported by a frame body 8. The frame body 8 is mounted above the lower casing 2, and the frame body 8 has a lithium battery 9, an ink cartridge 10 (integrated with a print head), a cleaner cartridge 14, and a control substrate 12 detachably loaded therein, respectively. The respective components are loaded into the frame body 8 from an upper side of the frame body 8.

Mounted on the control substrate 12 are an infrared ray receiving element 13 which receives image data through the infrared ray receiving section 4, a control section 160 (FIG. 15) to be described later, an SDRAM 32 (FIG. 15), and the like.

Figure 4:
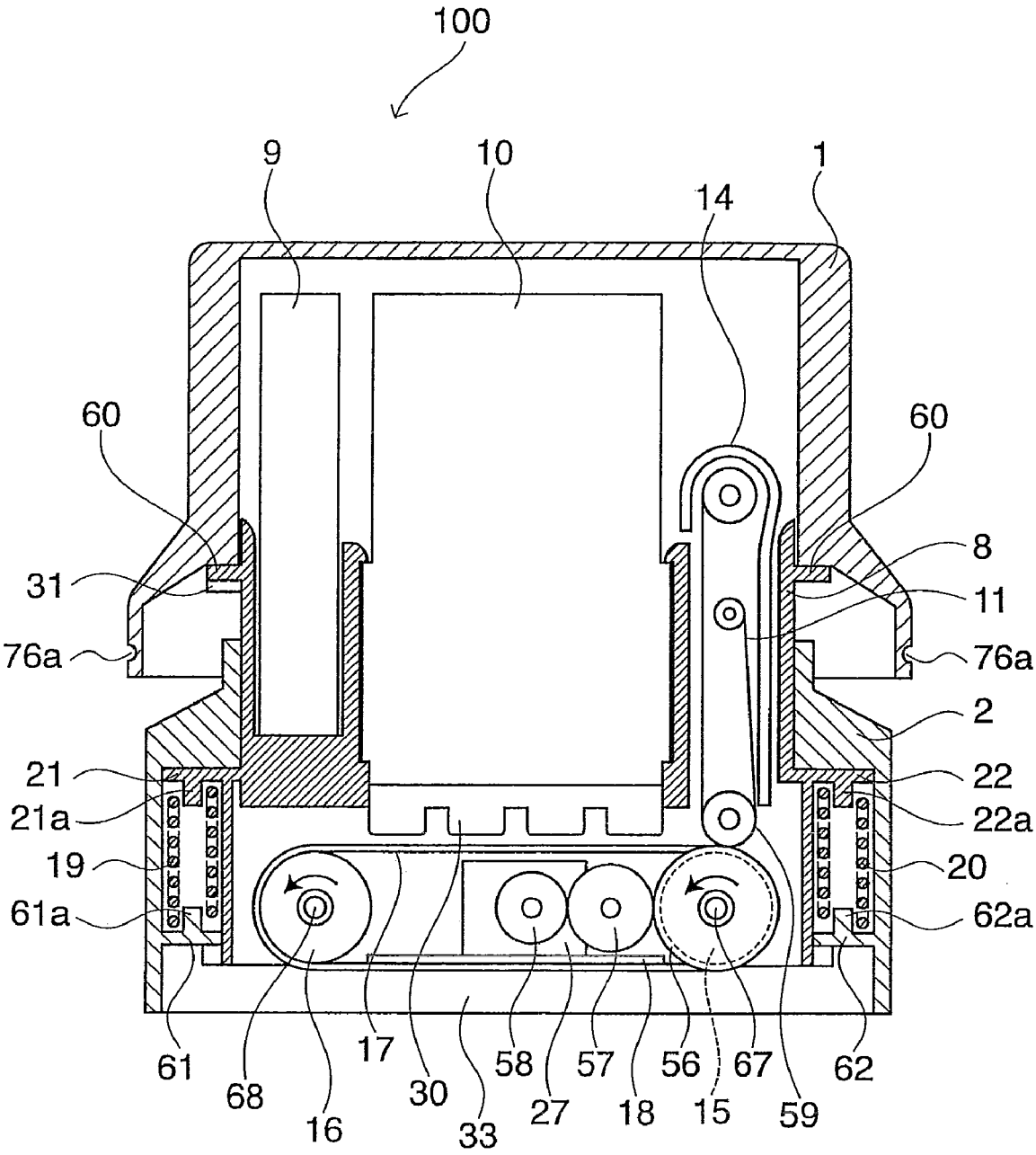
FIG. 4 is a cross-sectional view of the stamp-type printer of the present invention as viewed from its front side.

FIG. 4 is a cross-sectional view of the stamp-type printer 100 as viewed from its front side.

The stamp-type printer 100 includes a transfer belt 17 which act as a transfer member, a drive roller 15 and a tension roller 16 which each act as a transport member, a four-color inkjet head 30 which act as a print head, a supporting panel 18 which act as a supporting member, and the like. The upper casing 1 is detachably fitted to the frame body 8, and engaged with the same by engaging pieces 60.

A cleaner sheet 11 is set inside the cleaner cartridge 14, and a pressure is applied to the transfer belt 17 by a pressure roller 59 which is resiliently supported. The frame body 8 includes the drive roller 15 and tension roller 16 which drive the transfer belt 17. The transfer belt 17 is wound around the rollers 15 and 16, and the supporting panel 18 is provided on a back side of the transfer belt 17. Return springs 19 and 20 are provided between bosses 21*a* and 22*a* of lock claws 21 and 22 which protrude outward from both sides of the frame body 8, and bosses 61*a* and 62*a* of spring supporting pieces 61 and 62 which protrude inward from inner side walls of the lower casing 2, respectively.

With the return spring 19 and 20, the lower casing 2 is urged downwardly with respect to the frame body 8. Further, the lock claws 21 and 22 of the frame body 8 each function as stoppers for preventing the lower casing 2 from falling out. A stepping motor 27 is provided on the supporting panel 18, and a torque of the stepping motor 27 is transmitted from an output axis gear 58 to a drive roller gear 56 through a relay gear 57.

A bottom of the lower casing 2 is wholly open to form an opening portion 33. When the upper casing 1 is pressed downwardly at the time of the stamping operation, the transfer belt 17 is exposed from the opening portion 33. When the upper casing 1 is lowered, a stamp switch 31 (FIG. 4) which is provided on the frame body 8 comes in contact with the lower casing 2, and detects the stamping operation of the stamp-type printer 100.

Figure 5:
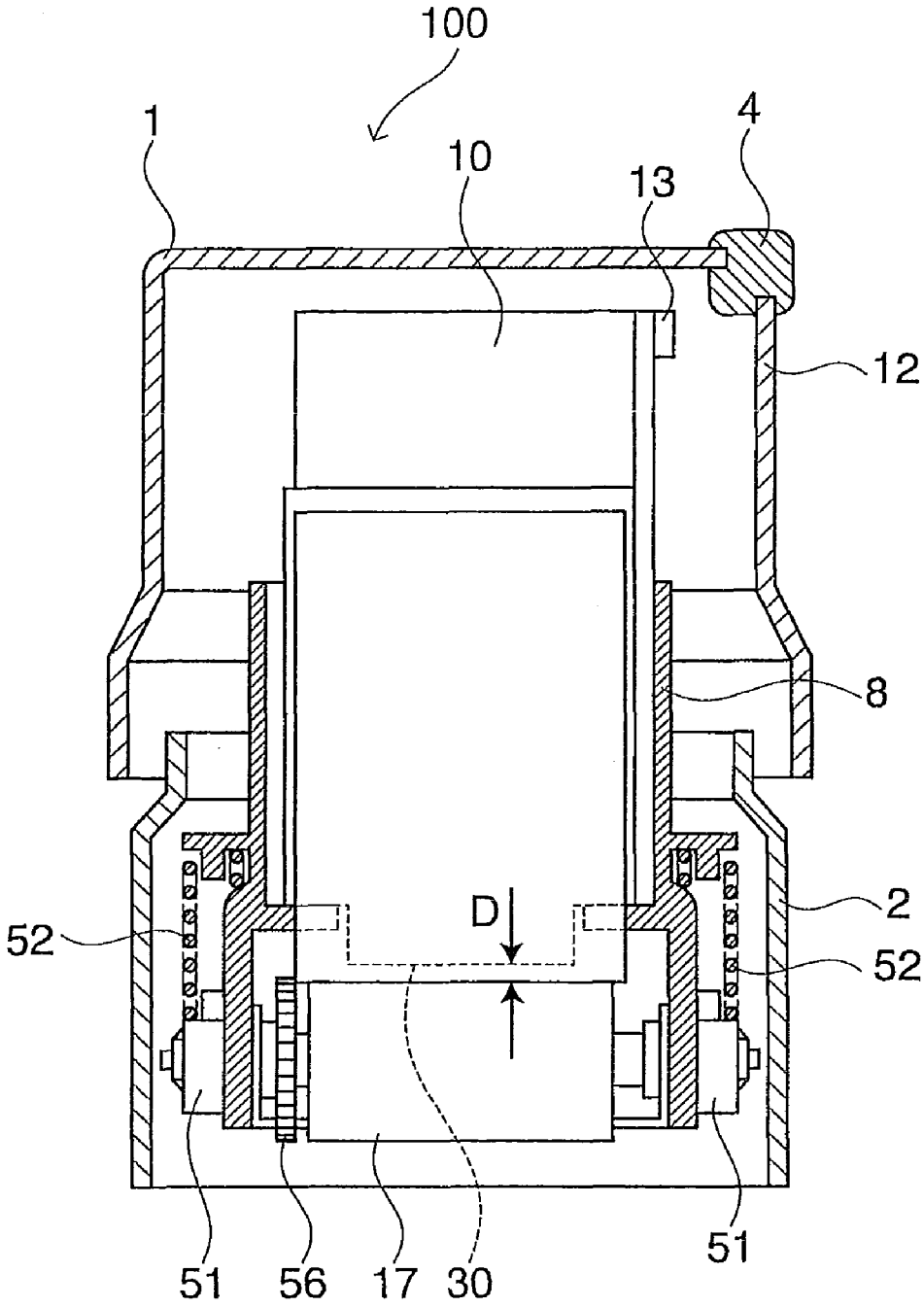
FIG. 5 is a cross-sectional view of the stamp-type printer of the present invention as viewed from its lateral side.

FIG. 5 is a cross-sectional view of the stamp-type printer 100 as viewed from its lateral side.

The four-color inkjet head 30 is protruded from a lower side of the ink cartridge 10 toward the transfer belt 17. The inkjet head 30 has an ink discharge nozzle array which is arranged in a width direction (main scanning direction) of the transfer belt 17, and ink to be discharged therefrom is supplied from the ink cartridge 10. The inkjet head 30 discharges ink in the main scanning direction with a single pass method, and the transfer belt 17 moves in the subscanning direction simultaneously, whereby the printing operation is performed. When performing the printing operation, a distance D between the ink discharge nozzle array and the transfer belt 17 is maintained at 1.0 mm.

Figure 6:
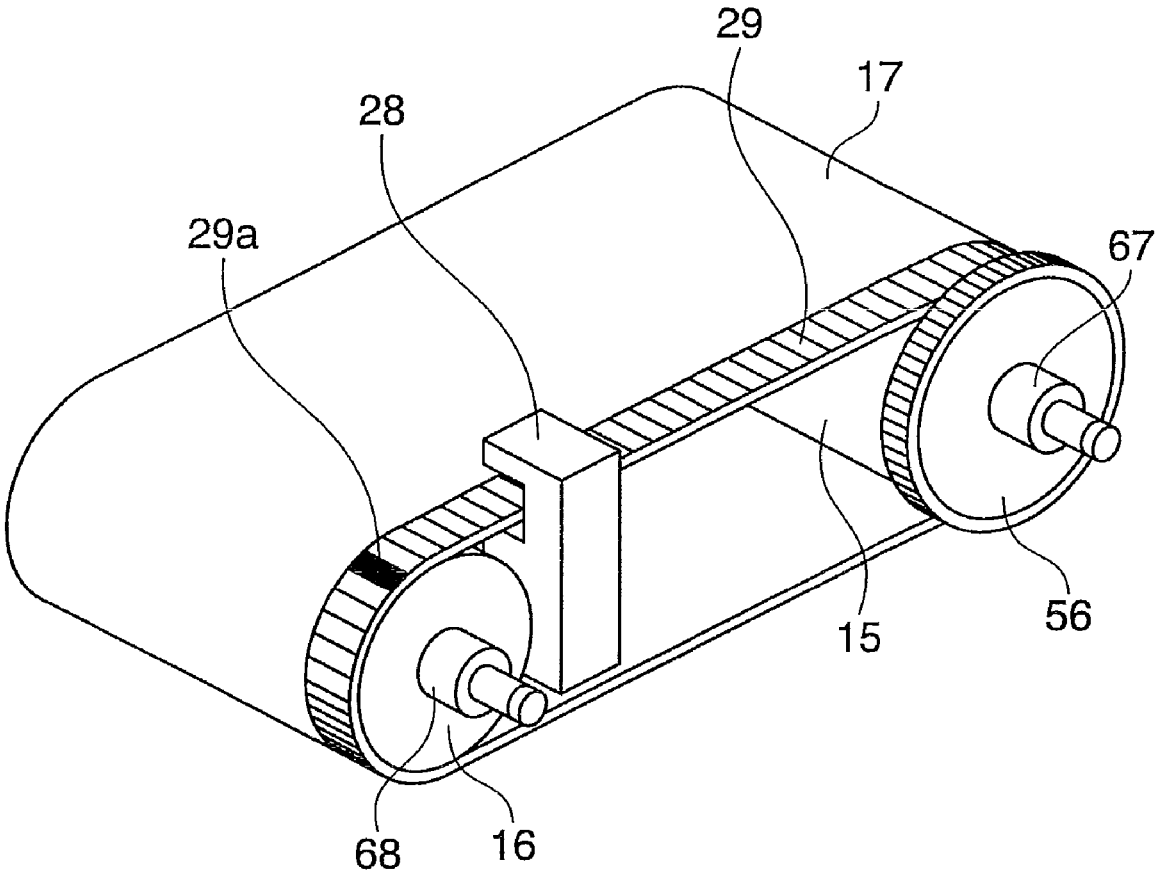
FIG. 6 is a perspective view of a major section of the stamp-type printer of the present invention.

FIG. 6 is a perspective view showing the transfer belt 17.

As above described, the transfer belt 17 is wound around the drive roller 15 and the tension roller 16. At an edge of the transfer belt 17, a printed section 29 used for reading of a position of the transfer belt 17 is provided, and the position is read by an encoder sensor 28.

Further, a bold line 29*a* in the printed section 29 is read by the encoder sensor 28 as an initial position (home position) of the transfer belt 17.

The transfer belt 17 is an endless belt whose base material is formed of ethylene terephthalate (PET) having a thickness of 0.35 mm. On a outer surface of the transfer belt 17 except for the printed section 29, PFA or PTFE coating is applied with a thickness of 30 μmm to 100 μmm so as to reduce ink adhesion. In order to increase the strength of the transfer belt 17, electroless metal plating, e.g., nickel plating may be applied on a front surface or a back surface of the base material of the transfer belt 17.

In the case where an ink image is stamped from the transfer belt 17 as shown in FIG. 2, in order to prevent insufficient image transfer which results from slack of the center of the transfer belt 17, the back surface of the transfer belt 17 is supported by the supporting panel 18, as shown in FIG. 4. Further, tension is applied to the transfer belt 17 by the tension roller 16, as described later, in order to prevent the slack of the transfer belt 17. With this arrangement, it is possible to prevent an image omission at the time of performing the stamping operation.

Figure 7:
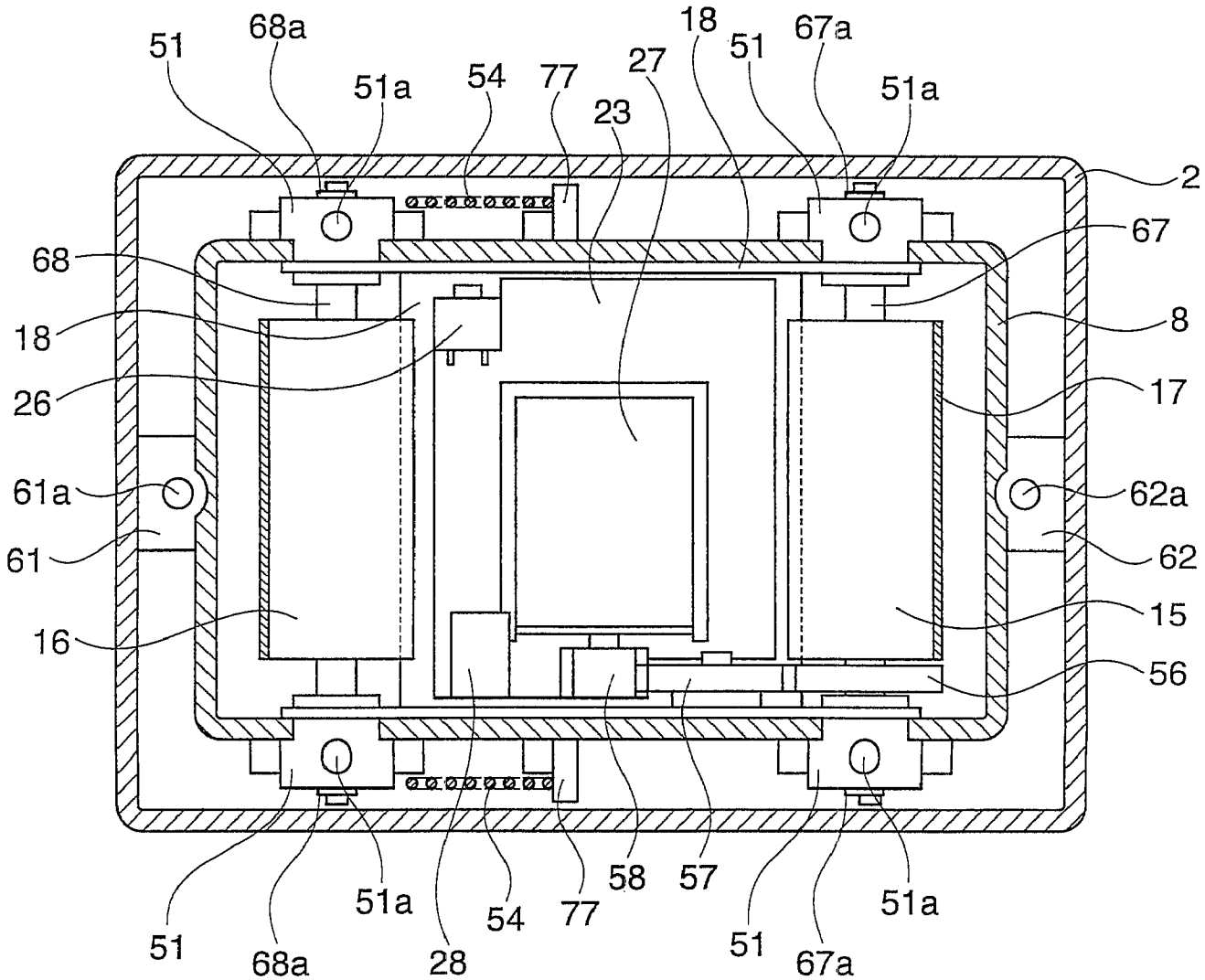
FIG. 7 is a lateral cross-sectional view of the stamp-type printer of the present invention.

FIG. 7 is a lateral cross-sectional view of the stamp-type printer 100, and shows a configuration of the frame body 8 accommodated thereinside.

As shown in FIG. 7, one end of a shaft 67 of the drive roller 15 passes through the drive roller gear 56 and a bearing unit 51, and has an E ring 67*a* situated at a tip end thereof for the purpose of slip-out prevention. The other end of the shaft 67 passes through another bearing unit 51, and has another E ring 67*a* situated at a tip end thereof for the purpose of slip-out prevention.

In the same manner, both ends of a shaft 68 of the tension roller 16 passes through the bearing units 51, and the E rings 67*a* and 68*a* are situated at both tip ends thereof for the purpose of slip-out prevention. Each of the four bearing units 51 passes through both of the frame body 8 and the supporting panel 18 (FIGS. 10A-10C) and is engaged thereon.

Further, an auxiliary substrate 23 is arranged on the supporting panel 18 and has a cover open/close switch 26 and the encoder sensor 28 mounted thereon.

Figure 8A:
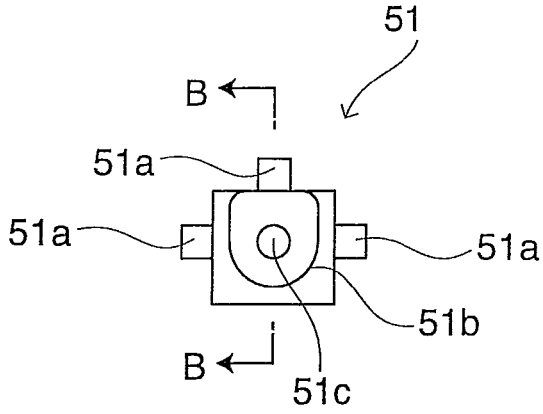
FIGS. 8A-8C are diagrams showing a structure of a bearing unit provided to the stamp-type printer of the present invention.
Figure 8B:
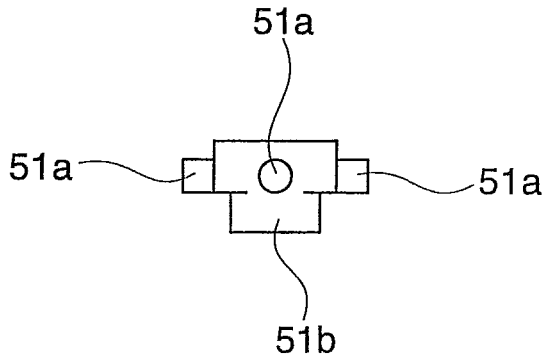
Figure 8C:
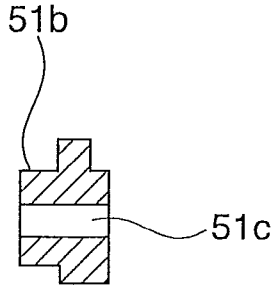

FIG. 8A shows a front view of the bearing unit 51, and FIG. 8B shows its top view, and FIG. 8C shows its cross-sectional view as viewed along arrows B-B shown in FIG. 8A. As shown in the drawings, the bearing unit 51 has bosses 51*a* formed on its upper, left, and right surfaces. The bearing unit 51 also has a protruding portion 51*b* which protrude from its front surface, and a through hole 51*c* for bearing a shaft.

Figure 9B:
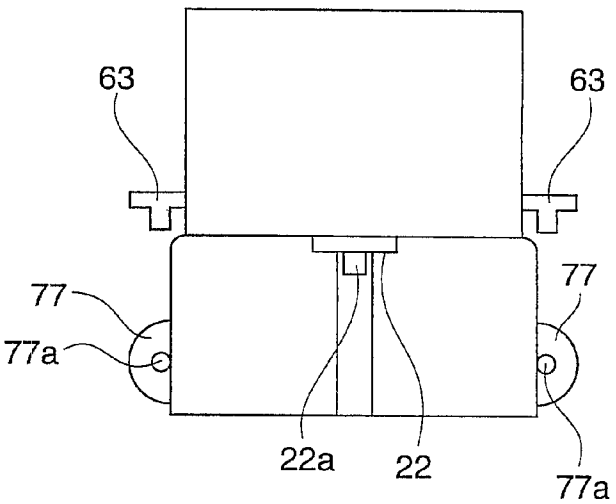
FIGS. 9A-9C are diagrams showing a structure of a frame body of the stamp-type printer of the present invention.
Figure 9C:
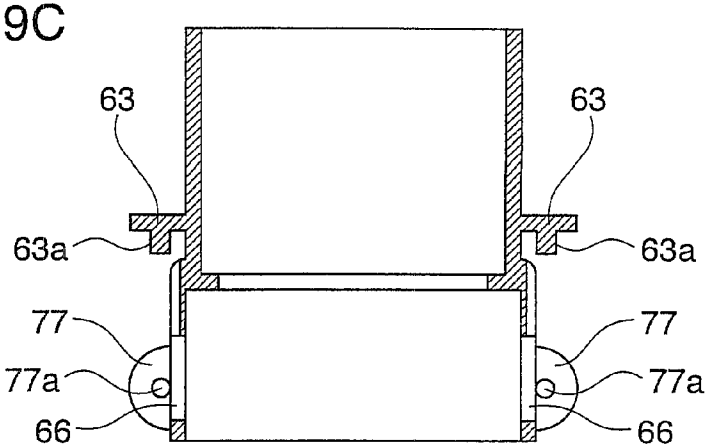
Figure 9A:
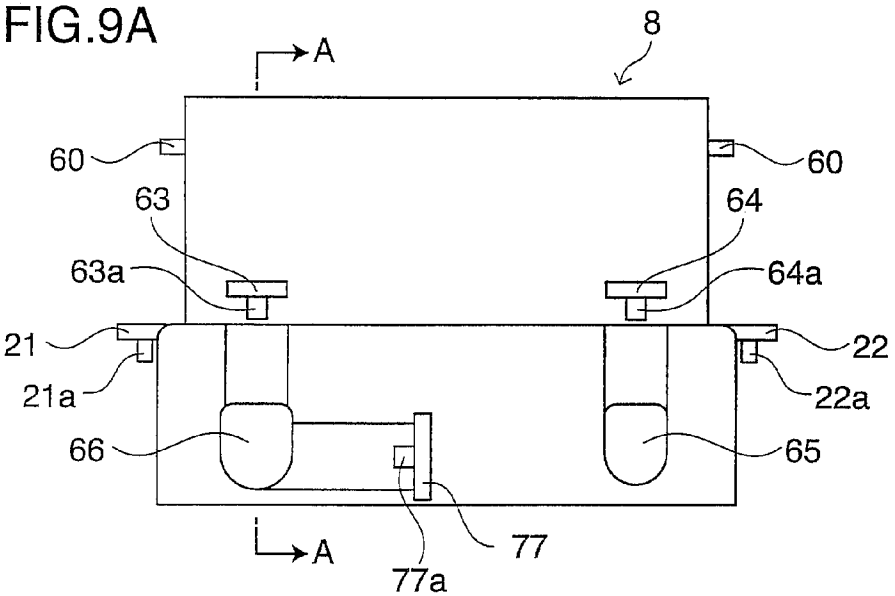

FIG. 9 is a diagram showing a structure of the frame body 8. FIG. 9A shows its front view, and FIG. 9B shows its side view, and FIG. 9C shows its cross-sectional view as viewed along arrows A-A shown in FIG. 9A. As shown in the drawings, two pairs of bearing unit through-holes 65 and 66 are arranged on front and back surfaces of the frame body 8, respectively.

To the respective bearing unit through-holes 65 and 66, the protruding portions 51*b* of the bearing units 51 are inserted, such that the respective bearing units 51 are supported by the frame body 8. The shape and the size of each bearing unit through-hole 65 are set such that the protruding portion 51*b* of each bearing unit 51 inserted to the bearing unit through-hole 65 can be moved in a range of ±1 mm vertically. Further, the shape and the size of each bearing unit through-hole 66 are set such that the protruding portion 51*b* of each bearing unit 51 inserted to the bearing unit through-hole 66 can be moved in a range of ±1 mm vertically as well as horizontally.

Further, two pairs of spring supporting pieces 63 and 64 are respectively provided on the front and back surfaces of the frame body 8, and the spring supporting pieces 63 and 64 have bosses 63*a* and 64*a* for fixing springs, respectively. Still further, two spring supporting pieces 77 each having a boss 77*a* are provided on the front and back surfaces of the frame body 8, and the lock claws 21 and 22 having the bosses 21*a* and 22*a*, respectively, are provided on left and right surfaces of the frame body 8.

Figure 10A:
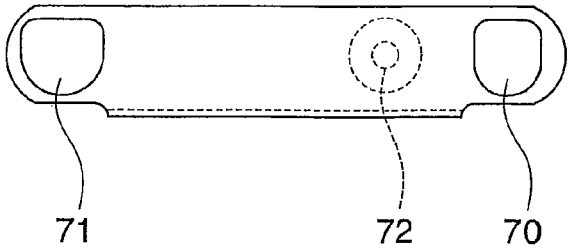
FIGS. 10A-10C are diagrams showing a structure of a supporting panel of the stamp-type printer of the present invention.
Figure 10B:
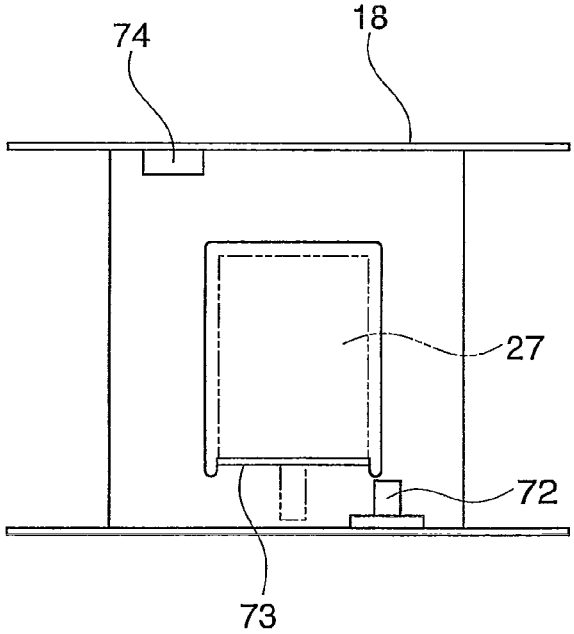
Figure 10C:
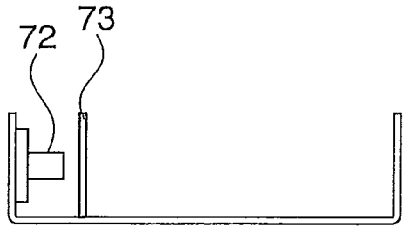

FIG. 10 is a diagram showing a structure of the supporting panel 18. FIG. 10A shows its front view, and FIG. 10B shows its top view, and FIG. 10C shows its side view. As shown in the drawings, two pairs of bearing unit through-holes 70 and 71 are formed on the front and back surface of the supporting panel 18, respectively. To the respective bearing unit through-holes 70 and 71, the protruding portions 51*b* of the bearing units 51 are inserted. The shape and the size of each bearing unit through-hole 70 are set such that the protruding portion 51*b* of each bearing unit 51 can be just fitted to the bearing unit through-hole 70. Further, the shape and the size of each bearing unit through-hole 71 are set such that the protruding portion 51*b* of each bearing unit 51 inserted to the bearing unit through-hole 71 can be moved in a range of ±1 mm horizontally.

As shown in FIG. 10B, the supporting panel 18 has a notched hole 74. The notched hole 74 is arranged so as to allow an actuating piece 75 (FIG. 13) for actuating the cover open/close switch 26 (FIG. 7) to pass therethrough. Further, the supporting panel 18 is provided with a motor fixing plate 73 for fixing the stepping motor 27, and a boss 72 for rotatably supporting the relay gear 57 (see FIG. 4).

As shown in FIG. 7, the pair of bearing units 51 supporting both ends of the shaft 67 of the drive roller 15 are supported by the frame body 8 in a manner that the protruding portion 51*b* of each bearing units 51 is inserted to both of the bearing unit through-hole 65 of the frame body 8 and the bearing unit through-hole 70 of the supporting panel 18. In a similar manner, the pair of bearing units 51 supporting both ends of the shaft 68 of the tension roller 16 are supported by the frame body 8 in a manner that the protruding portion 51*b* of each bearing units 51 is inserted to both of the bearing unit through-hole 66 of the frame body 8 and the bearing unit through-hole 71 of the supporting panel 18.

Figure 11:
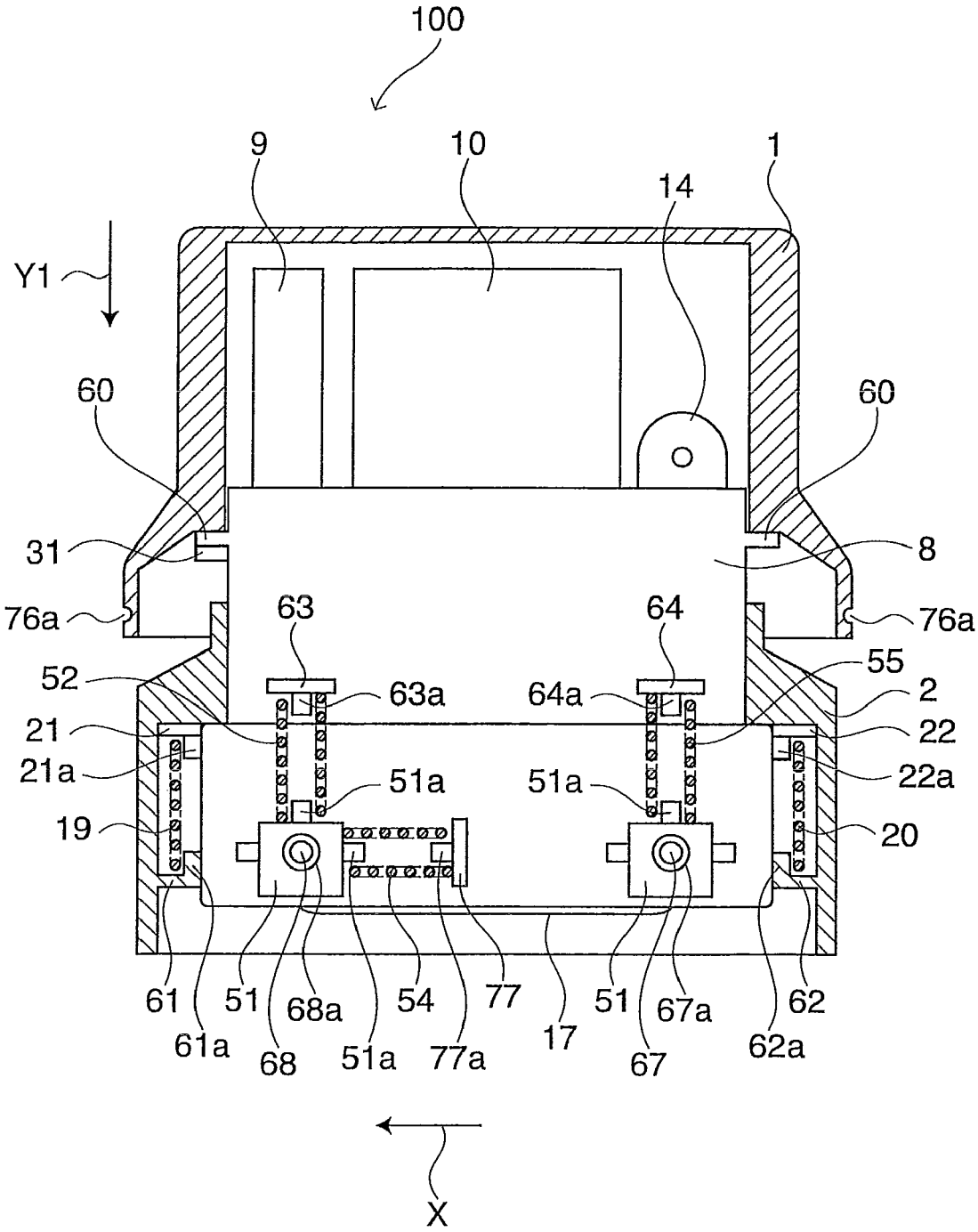
FIG. 11 is a diagram corresponding to FIG. 4 and showing an outer surface configuration of the frame body of the stamp-type printer of the present invention.

FIG. 11 is a diagram corresponding to FIG. 4 and showing an outer configuration of the frame body 8 housed in the housing 50. As shown in the drawing, a bearing unit urging spring 55 urges the bearing units 51 supporting the shaft 67 in the direction indicated by an arrow Y1, the bearing unit urging spring 55 being supported between the boss 51*a* on the upper surface of the bearing unit 51 supporting the shaft 67 and the boss 64*a* of the spring supporting piece 64 provided on the outer surface of the frame body 8.

In a similar manner, a bearing unit urging spring 52 urges each of the bearing units 51 supporting to the shaft 68 in the direction indicated by the arrow Y1, the bearing unit urging spring 52 being supported between the boss 51*a* on the upper surface of bearing unit 51 supporting the shaft 68 and the boss 63*a* of the spring supporting piece 63 provided on the outer surface of the frame body 8.

When the shafts 67 and 68 are in the above-described state, the distance between the inkjet head 50 and the transfer belt 17 satisfies D=1 mm, as shown in FIG. 5.

Further, a belt urging spring 54 urges the bearing units 51 supporting the shaft 68 in the direction indicated by an arrow X, the belt urging spring 54 being supported between the boss 51*a* on the side surface of bearing unit 51 supporting the shaft 68 and the boss 77*a* of the spring supporting piece 77 provided on the outer surface of the frame body 8. Accordingly, the tension roller 16 (see FIG. 4 and FIG. 6) moves in the arrow X direction by 1 to 2 mm, and applies tension to the transfer belt 17 (FIG. 6).

Figure 12:
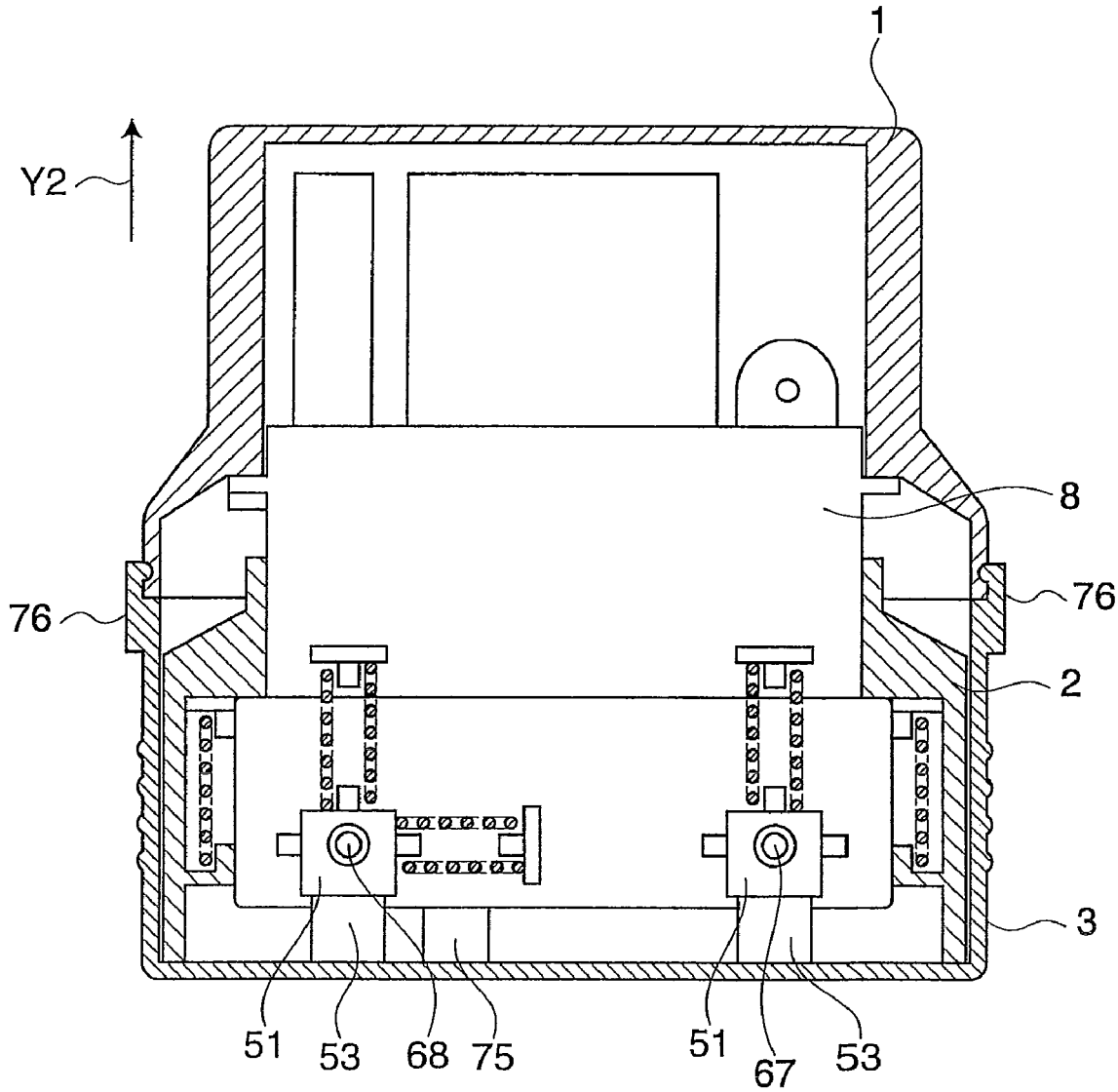
FIG. 12 is a diagram corresponding to FIG. 11 and showing a case where a cover is fitted to the stamp-type printer of the present invention.
Figure 13:
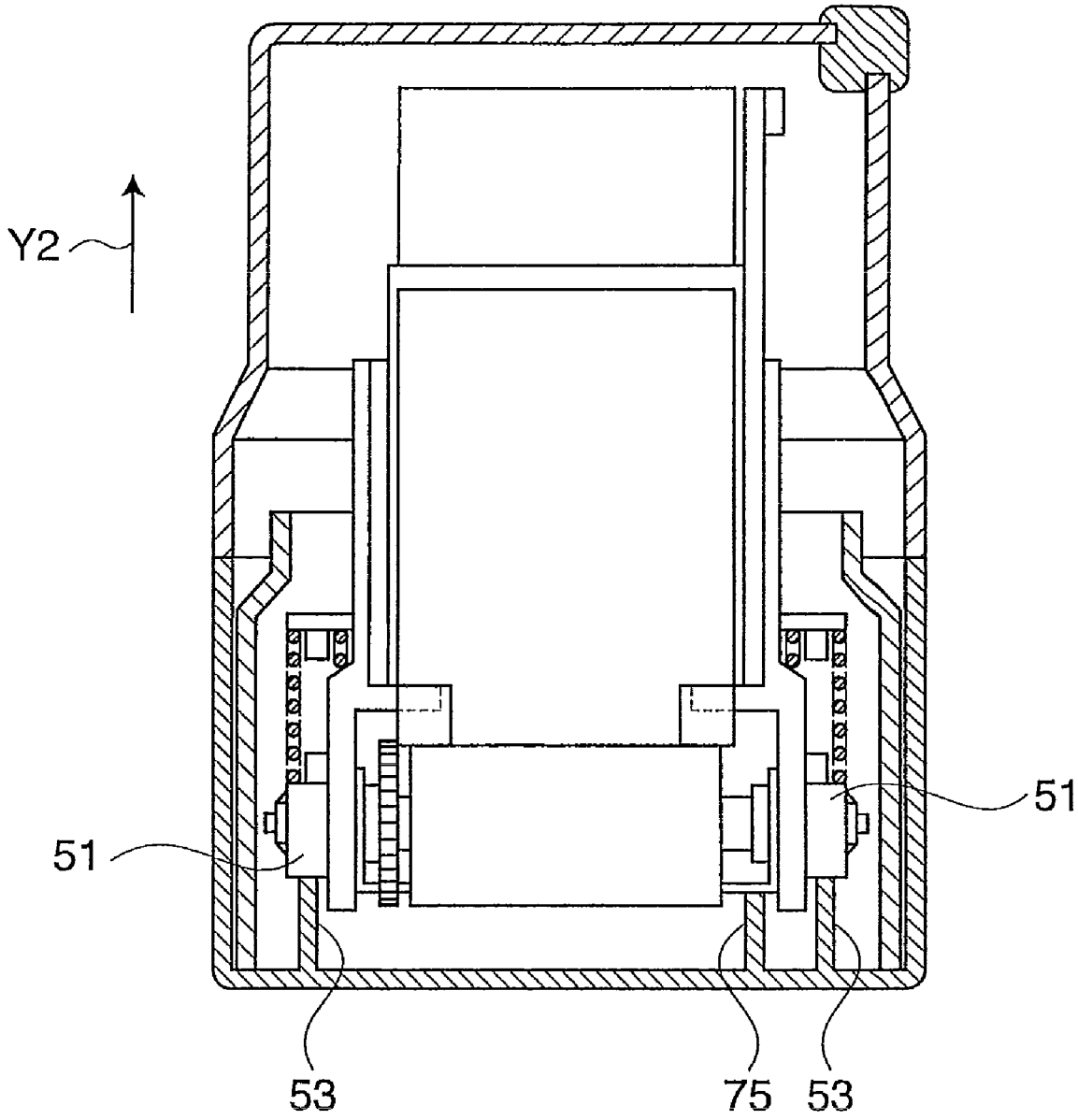
FIG. 13 is a diagram corresponding to FIG. 5 and showing a case where the cover is fitted to the stamp-type printer of the present invention.

FIG. 12 and FIG. 13 are diagrams corresponding to FIG. 11 and FIG. 5 respectively, and each shows a case where the cover 3 is fitted to the stamp-type printer 100. When the cover 3 is fitted, the locking section 76 is locked with the upper casing 1, and the cover 3 is firmly fixed with the upper casing 1. In this case, four ribs 53 (see FIG. 1B) arranged in an inner bottom surface of the cover 3 pushes their corresponding four bearing units 51 upwardly in the direction indicated by an arrow Y2.

Accordingly, as shown in FIG. 13, the transfer belt 17 comes in close contact with the inkjet head 30, which satisfies D=0, and as a result, the nozzle of the inkjet head 30 is sealed by the transfer belt 17 whereby clogging of the nozzle due to dried ink is prevented.

Figure 14:
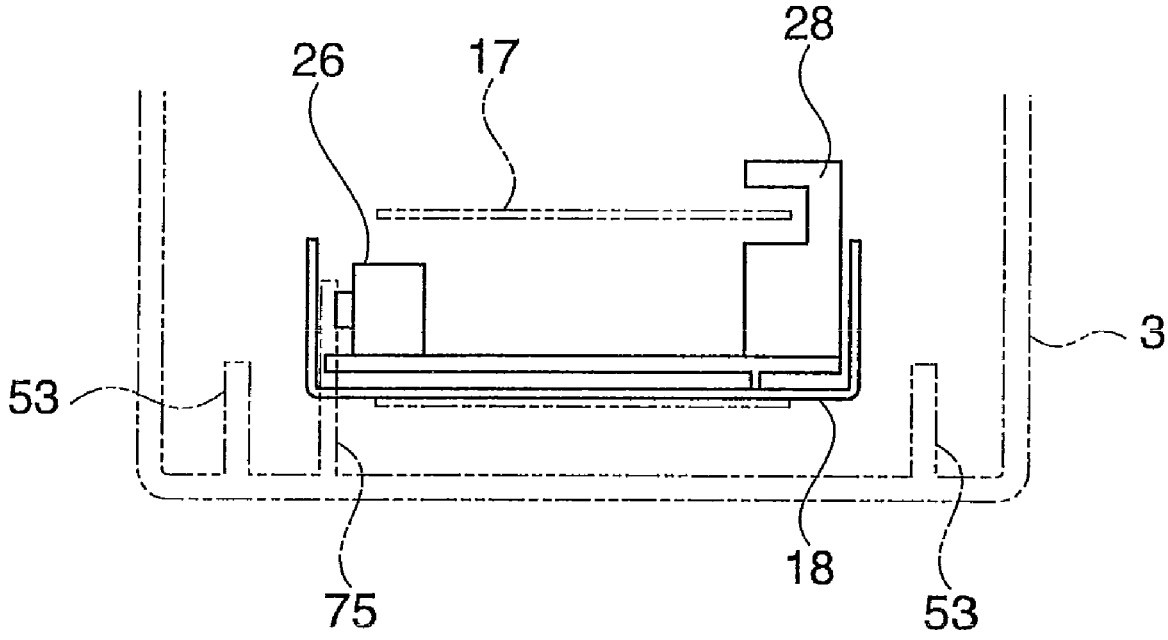
FIG. 14 is a diagram schematically showing a function of the cover when the cover is fitted to the stamp-type printer of the present invention.

Further, in this case, the actuating piece 75 standing up from the inner bottom surface of the cover 3 turns OFF the cover open/close switch 26 as shown in FIG. 14.

Figure 15:
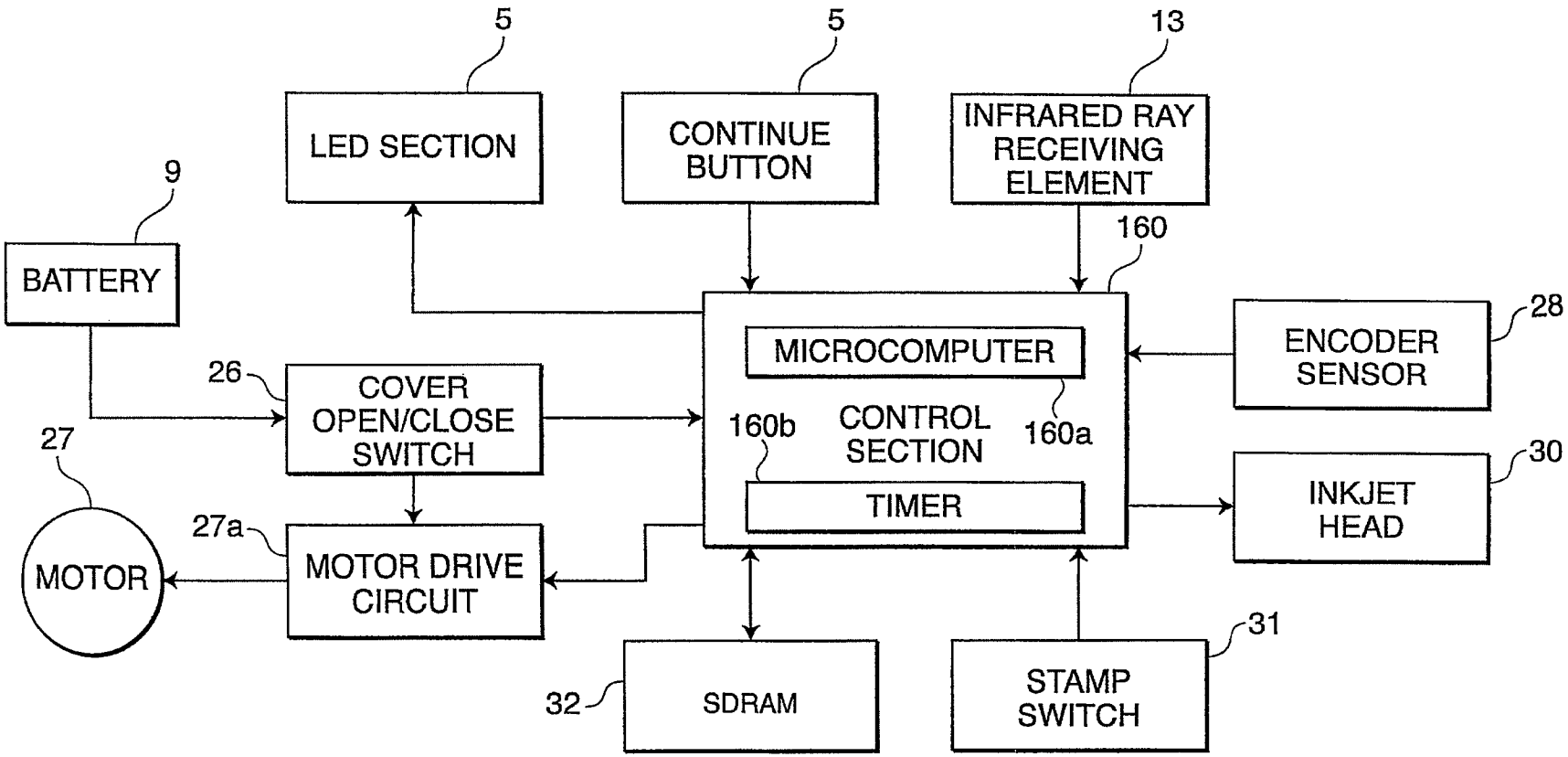
FIG. 15 is a block diagram of a control system of the stamp-type printer of the present invention.

FIG. 15 is a block diagram showing a control system of the stamp-type printer 100.

As shown in FIG. 15, the power from the lithium battery 9 is supplied to the control section 160 and a motor drive circuit 27*a* via the cover open/close switch 26. The control section 160 receives outputs from the infrared ray receiving element 13, a continue switch 25, the encoder sensor 28 and the stamp switch 31. The control section 160 outputs then outputs to the inkjet head 30, the LED section 5, and the motor drive circuit 27*a*.

The control section 160 includes a microcomputer 160*a* which is composed of a CPU, a ROM, and a RAM, and a timer 160*b*. The control section 160 also includes the SDRAM 32 for storing image data received from the infrared ray receiving element 13. Further, the motor drive circuit 27*a* is designed to receive a control signal from the control section 160 and drive-control the stepping motor 27.

Figure 16:
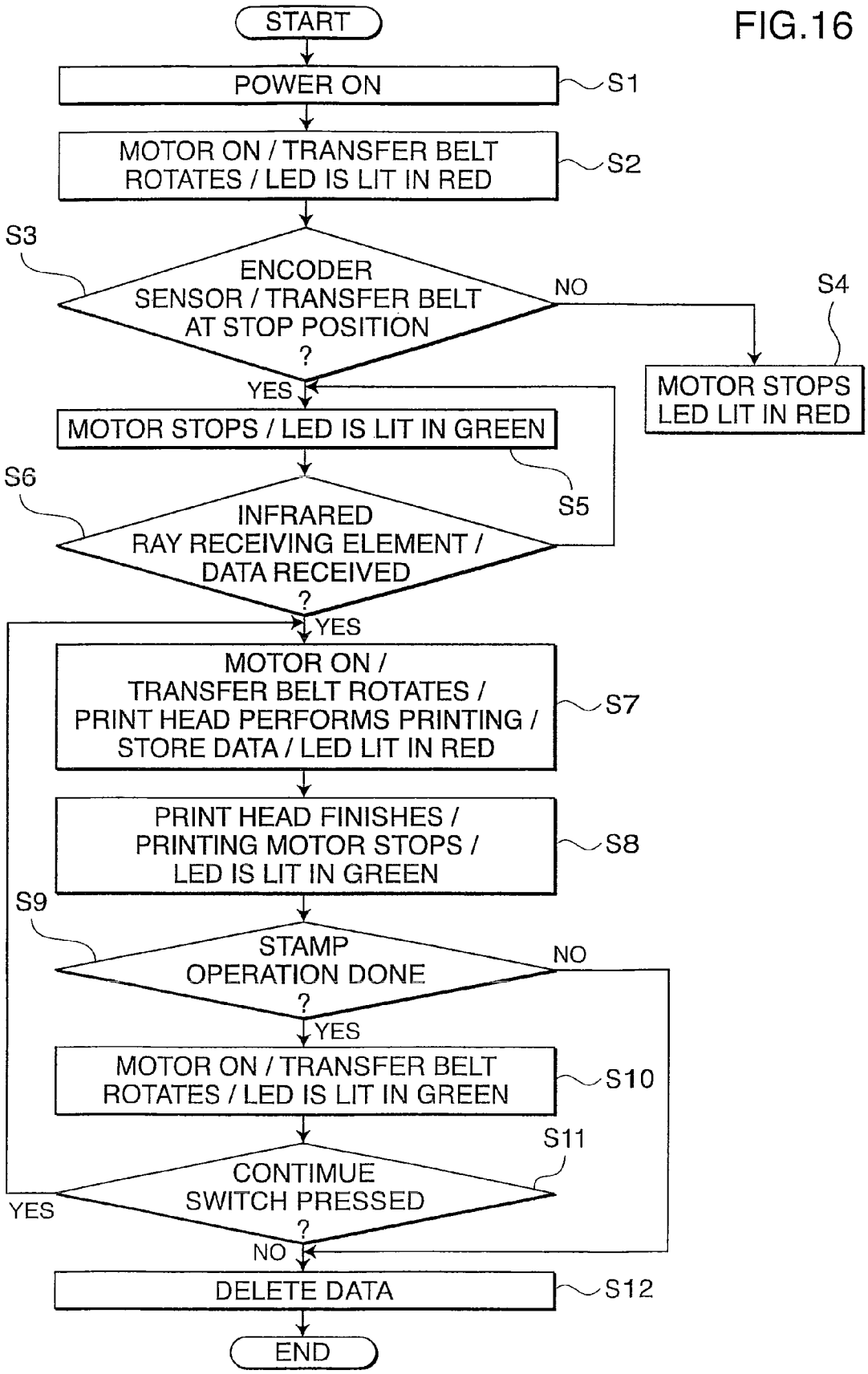
FIG. 16 is a flowchart showing an operation of the stamp-type printer of the present invention.

Next, an operation of the stamp-type printer 100 will be described with reference to a flowchart shown in FIG. 16.

When the cover 3 is removed, the transfer belt 17 becomes distant from the inkjet head 30, and the distance therebetween satisfies D=1 mm. Accordingly, the cover open/close switch 26 is turned on, and the power is turned on (step S1). Then, as an initial operation, the stepping motor 27 rotates to drive the transfer belt 17 and the transfer belt 17 is cleaned with a cleaner sheet in the cleaner cartridge 14. In order to notify a user that the cleaning is carried out, the LED section 5 is continuously lit in red (step S2) during the cleaning period. Whether or not the bold line (home position) 29*a* on the transfer belt 17 (FIG. 6) is read by the encoder sensor 28 is determined (step S3).

When the bold line 29*a* is read, the stepping motor 27 stops immediately. The color of the lit LED section 5 is switched from red to green to notify the user that the stamp-type printer is ready to receive print data (step S5). If the stepping motor 27 does not operate normally due to battery power shortage or the like, the encoder sensor 28 cannot detect the bold line 29*a* on the transfer belt 17 within a predetermined period of time. As a result, the stepping motor 27 stops, and the LED section 5 is lit in red continuously (step S4).

When infrared data is outputted from a portable terminal or the like, and the infrared ray receiving element 13 receives the data completely, that is, when two seconds has passed from the start of the data reception (step S6), the stepping motor 27 causes the transfer belt 17 to move at a subscanning speed and the ink discharge nozzle array of the inkjet head 30 discharges ink in the main scanning direction.

Accordingly, image data is printed on the transfer belt 17 to form an ink image, and the image data is stored in the SDRAM 32. At the same time, the LED section 5 is lit in red so as to notify the user that the ink image is being formed on the transfer belt 17 (step S7).

When the ink image is completely formed on the transfer belt 17, the transfer belt 17 moves at a high speed, and stops when the ink image reaches a position facing the opening portion 33 (position where contact transfer can be performed). The LED section 5 blinks in green so as to notify the user that a stamping operation is ready (step S8).

The user positions the opening portion 33 of the stamp-type printer just on a position where the ink image is to be printed (a desired recording medium) and performs a stamping (contact transfer) operation of the ink image thereon. When the stamp switch 31 has sensed the stamping operation (step S9), the stepping motor 27 rotates to drive the transfer belt 17, and the transfer belt 17 is cleaned with the cleaner sheet 11. When the bold line 29 on the transfer belt 17 is read by the encoder sensor 28 (at the home position), the stepping motor 27 then stops, and the LED section 5 is switched to a continuous green lighting state (step S110).

Thereafter, duration after the stamping operation is measured by the timer 160*b*. When the continue button 5 is not pressed within a predetermined period of time (e.g., within 60 seconds) (step S11), the control section 160 determines that continuous stamping operation is neglected, and the routine returns to the initial operation. Further, the image data stored in the SDRAM 32 is deleted (step S12). In the case where the user is to stamp the same data again (step S11), when the user presses the continue button 5 within the predetermined period of time, the image data is read from the SDRAM 32, the routine returns to step S7, and the stamping operation is again ready to be performed.

What is claimed is:

1. A stamp-type printer comprising:

a receiving section for receiving image data including character information;

a transfer member;

a print head for printing an image on a portion of the transfer member with ink based on the received image data;

a transport member for transporting the printed portion of the transfer member to a contact transfer position;

a frame body for supporting the print head, the transfer member, and the transport member, and a housing for accommodating the frame body, wherein the housing has an opening for causing the printed portion located in the contact transfer position to be exposed therethrough, and wherein a stamping operation is performed by causing the printed portion to come in contact with a desired recording medium at the contact transfer position.

2. The stamp-type printer according to claim 1, further comprising:

an infrared ray receiving element in the receiving section, and a control section for causing the receiving section to receive the image data through the infrared ray receiving element and for causing the print head to execute a printing operation.

3. The stamp-type printer according to claim 2, further comprising:

a display section for indicating a timing at which reception of the image data is ready.

4. The stamp-type printer according to claim 2, further comprising:

a storage section for temporarily storing the received image data; and a manual instruction member for providing an instruction to the control section to cause the print head to print the stored data on the transfer member.

5. The stamp-type printer according to claim 4, wherein the control section includes a time measuring section for measuring time, and the control section deletes the image data stored in the storage section when the manual instruction member provides no instruction over a predetermined period of time.

6. The stamp-type printer according to claim 1, wherein the print head includes an inkjet head with an ink discharge nozzle array, and the transfer member includes an endless belt, the print head printing the image onto the transfer member when the ink discharge nozzle array discharges ink in a main scanning direction of the endless belt and the transport member causes the endless belt to move in a subscanning direction.

7. The stamp-type printer according to claim 1, wherein the housing includes an upper casing removably supported by the frame body, and a lower casing having the opening.

8. The stamp-type printer according to claim 7, wherein the lower casing supports the frame body through a resilient member, and the printed portion is exposed through the opening to come in contact with the recording medium, when the frame body is moved with respect to the lower casing in a manner to resist the resilient member.

9. The stamp-type printer according to claim 8, further comprising:

a cover detachably attached to the housing to cover the opening, wherein the cover is adapted to prevent the frame body from moving with respect to the lower casing when the cover is attached to the housing.

10. The stamp-type printer according to claim 9, wherein the frame body includes a holding member for holding the transfer member distant from the print head when the print head prints the image on the transfer member, and the cover includes ribs for causing the transfer member to come in contact with the print head when the cover is attached to the housing.

11. The stamp-type printer according to claim 7, further comprising:

a cleaning member for cleaning the transfer member; and a battery for driving the print head, wherein the cleaning member, the print head and the battery are supported by the frame body and are replaceable when the upper casing is removed.

12. The stamp-type printer according to claim 1, further comprising:

a cover detachably attached to the housing to cover the opening.

13. The stamp-type printer according to claim 12, further comprising:

a control section for driving the print head and the transport member; and a power source for supplying power to the control section through a switch, wherein the switch is opened when the cover is detached from the housing and closed when attached to the housing.

14. The stamp-type printer according to claim 12, wherein the cover and the frame body include a mechanism for causing the transfer member to come in contact with the print head when the cover is attached to the housing.

15. The stamp-type printer according to claim 1, further comprising:

a cleaning member for cleaning the transfer member.

16. The stamp-type printer according to claim 1, further comprising:

a display section for indicating that the printed portion of the transfer member has been transported to the contact transfer position.

17. The stamp-type printer according to claim 1, further comprising:

a detector for detecting a position of the transfer member; and a control section for driving the transport member in accordance with an output from the detector.

18. The stamp-type printer according to claim 1, wherein the transfer member includes an endless transfer belt, and the transport member includes a drive roller and a tension roller which support the transfer belt therebetween to drive the endless transfer belt.

19. The stamp-type printer according to claim 18, further comprising:

a supporting member for supporting the transfer belt from a rear side thereof.

20. The stamp-type printer according to claim 18, further comprising:

an urging member for urging the tension roller to apply tension to the transfer belt.

21. The stamp-type printer according to claim 18, wherein the transfer belt has a front surface coated with a PFA or a PTFE.

* * * * *